US005306860A

United States Patent [19]

Bigeard et al.

[11] Patent Number: 5,306,860

[45] Date of Patent: Apr. 26, 1994

[54] METHOD OF HYDROISOMERIZING PARAFFINS EMANATING FROM THE FISCHER-TROPSCH PROCESS USING CATALYSTS BASED ON H-Y ZEOLITE

[75] Inventors: Pierre-Henri Bigeard, Vienne; Alain Billon, Le Vesinet; Pierre Dufresne, Rueil Malmaison; Samuel Mignard, Chatou, all of France

[73] Assignee: Institut Francais du Petrole, Rueil Malmaison, France

[21] Appl. No.: 886,224

[22] Filed: May 21, 1992

[30] Foreign Application Priority Data

May 21, 1991 [FR] France ..... 91 06140

[51] Int. Cl.[5] ..... C07C 5/13; C07C 5/22

[52] U.S. Cl. ..... 585/737; 585/265; 585/310; 585/733; 585/739; 585/946; 208/950

[58] Field of Search ..... 585/265, 736, 739, 946, 585/603, 606; 208/59, 89, 210, 950

[56] References Cited

U.S. PATENT DOCUMENTS

| | | | |
|---|---|---|---|
| 3,147,210 | 9/1964 | Hass et al. | 585/265 |
| 3,647,678 | 3/1972 | Egan et al. . | |
| 3,974,061 | 8/1976 | Quisenberry | 585/736 |
| 4,041,097 | 8/1977 | Ireland et al. | 260/676 |
| 4,046,831 | 9/1977 | Kuo | 260/676 |
| 4,080,397 | 3/1978 | Derr et al . | 260/676 |
| 4,252,736 | 2/1981 | Haag et al. | 260/450 |
| 4,471,145 | 9/1984 | Chu et al. | 585/322 |
| 4,544,792 | 10/1985 | Smith et al. | 585/533 |
| 4,645,585 | 2/1987 | White | 585/353 |
| 4,684,756 | 8/1987 | Derr, Jr. et al. | 585/330 |
| 4,738,940 | 4/1988 | Dufresne et al. . | |
| 4,832,819 | 5/1989 | Hamner | 208/736 |
| 4,919,786 | 4/1990 | Hamner | 585/736 |
| 4,943,672 | 7/1990 | Hamner et al. | 585/737 |
| 5,059,299 | 10/1991 | Cody et al. | 208/27 |

FOREIGN PATENT DOCUMENTS

| | | |
|---|---|---|
| 0310165 | 4/1989 | European Pat. Off. . |
| 0321303 | 6/1989 | European Pat. Off. . |

*Primary Examiner*—Anthony McFarlane

*Attorney, Agent, or Firm*—Millen, White, Zelano, & Branigan

[57] ABSTRACT

For Hydroisomerizering charges emanating from the Fischer-Tropsch process:

a) hydrogen is reacted with the charge in contact with a catalyst 1 in a first reaction zone, the catalyst 1 comprising at least one alumina-based matrix and at least one hydro-dehydrogenation component and b) the effluent from the first reaction zone is put into contact with a catalyst 2 in a second reaction zone, the catalyst 2 comprising:

20 to 97% by weight of at least one matrix, 3 to 80% by weight of at least one Y zeolite in hydrogen form, the zeolite being characterized by an $SiO_2/Al_2O_3$ molar ratio of over 4.5; a sodium content of less than 1% by weight determined at 1100° C. under calcining conditions; an $a_o$ crystal parameter of the elemental mesh of less than $24.70\times10^{-10}$ m; and a specific surface area determined by the BET method of over 400 $m^2.g^{-1}$, and at least one hydro-dehydrogenation component.

21 Claims, No Drawings

METHOD OF HYDROISOMERIZING PARAFFINS EMANATING FROM THE FISCHER-TROPSCH PROCESS USING CATALYSTS BASED ON H-Y ZEOLITE

BACKGROUND OF THE INVENTION

The invention concerns a method of hydroisomerizing paraffins emanating from the Fischer-Tropsch process. It particularly uses bifunctional zeolitic catalysts for hydroisomerizing paraffins emanating from the Fischer-Tropsch process, enabling highly upgradable products to be obtained, such as kerosene, gas oil and especially basic oils.

More particularly, the invention concerns a method of converting paraffins emanating from the Fischer-Tropsch process using a bifunctional catalyst containing a faujasite-type zeolite which may be specially modified, dispersed in a matrix generally based on alumina, silica, silica-alumina, alumina-boron oxide, magnesia, silica-magnesia, zirconia, titanium oxide or based on a combination of at least two of the preceding oxides, or based on a clay or a combination of the preceding oxides with clay. The special function of the matrix is to help to shape the zeolite, in other words, to produce it in the form of agglomerates, spheres, extrusions, pellets, etc. which can be put in an industrial reactor. The proportion of matrix in the catalyst is from 20 to 97% by weight and preferably from 50 to 97% by weight.

In the Fischer-Tropsch process the synthesis gas (CO+H2) is converted catalytically to oxygenated products and essentially linear hydrocarbons in gas, liquid or solid form. These products are generally free from heteroatomic impurities such as sulphur, nitrogen or metals. The products cannot, however, be used as they are, chiefly because their cold-resistance properties are incompatible with the normal uses of petroleum cuts. For example, the pour point of a linear hydrocarbon containing 30 carbon atoms per molecule (boiling point equal to about 450° C., i.e., included in the oil cut) is about +67° C., whereas certain specifications require a pour point below −9° C. for commercial oils. These hydrocarbons from the Fischer-Tropsch process then have to be converted to more upgradable products, such as basic oils, after undergoing catalytic hydroisomerization reactions.

Catalysts which are currently used in hydroisomerization are all of the bifunctional type, combining an acid and a hydrogenating function. The acid function is provided by carriers of large surface area (generally 150 to 800 $m^2.g^{-1}$) which have surface acidity, such as halogenated (especially chlorinated or fluorinated) aluminas, combinations of boron oxides with aluminum, amorphous silica-aluminas and zeolites. The hydrogenating function is provided either by one or more metals from Group VIII of the Periodic Table, such as iron, cobalt, nickel, ruthenium, rhodium, palladium, osmium, iridium and platinum, or by a combination of a Group VI metal, such as chromium, molybdenum and tungsten, with at least one Group VIII metal.

Equilibrium between the acid and hydrogenating functions is the fundamental parameter governing the activity and selectivity of the catalyst. A weak acid function and a strong hydrogenating function give catalysts which are inactive and selective to isomerization, whereas a strong acid function and a weak hydrogenating function give catalysts which are very active and selective to cracking. A third possibility is to use a strong acid function and a strong hydrogenating function to obtain a catalyst which is very active but also very selective to isomerization. It is thus possible to adjust the dual activity/selectivity property of the catalyst by choosing each of the functions carefully.

Acid carriers - in increasing order of acidity - include aluminas, halogenated aluminas, amorphous silica-aluminas and zeolites.

Patent application EP 323 092 describes a catalyst comprising fluorine and platinum on an alumina carrier which is used in hydroisomerization.

Patent application EP 356 560 describes the preparation of a highly specific Y zeolite, which may be used in a catalyst for the Fischer-Tropsch Synthesizing reaction or in a hydrocracking catalyst.

SUMMARY OF THE INVENTION

The catalyst of the invention contains a Y zeolite of faujasite structure (Zeolite Molecular Sieves Structure, Chemistry and Use, D. W. Breck, J. Willey and Sons, 1973). Of the zeolites which may be used, it is preferable to employ stabilized Y zeolite, currently described as ultrastable or USY, either in a form partially exchanged with cations of rare earths with an atomic number from 57 to 71 inclusive, so that its rare earth content, expressed as a percentage by weight of rare earth oxides, is less than 10% and preferably less than 6%, or in hydrogen form.

It has now been surprisingly discovered that the use of a catalyst comprising such an Y zeolite makes it possible to obtain catalysts which are very active but also very selective to isomerization of charges emanating from the Fischer-Tropsch process. This high selectivity is obtained by using a strong hydrogenating function.

The zeolite used in the catalyst of the invention is preferably an HY acid zeolite characterized by various specifications: an $SiO_2/Al_2O_3$ molar ratio over 4.5 and preferably from 8 to 70; a sodium content less than 1% by weight and preferably less than 0.5% by weight, determined on zeolite calcined at 1100° C.; an $a_o$ crystal parameter of the elemental mesh less than $24.70\times10^{-10}$ meters and preferably from $24.24\times10^{-10}$ to $24.55\times10^{-10}$ meters, and a specific surface area determined by the BET method of over 400 m2/g and preferably over 550 m2/g.

The various properties are measured by the methods specified below:

- the $SiO_2Al_2O_3$ molar ratio is measured by X-radiation. When the quantities of aluminum become small, e.g., less than 2%, it is opportune to use a method of determination by atomic adsorption spectrometry for greater precision;
- the mesh parameter is calculated from the X-ray diffraction diagram, by the method described in ASTM D3.942-80;
- the specific surface area is determined by measuring the nitrogen adsorption isotherm at the temperature of liquid nitrogen, and calculated by the classic BET method. The samples are pretreated, before being measured, at 500° C. with dry nitrogen scavenging.

This zeolite is known from prior art (French patent 2 561 946). The NaY zeolite, which generally provides the raw material, contains over 5% by weight of sodium and has an $SiO_2/Al_2O_3$ molar ratio from 4 to 6. It is not used as it is, and has to undergo a series of stabilization treatments designed to increase its acidity and heat resistance.

It may be stabilized by various methods.

Y zeolite stabilization is most commonly carried out either by introducing cations of rare earths or cations of Group IIA metals or by hydrothermal treatment. All these treatments are described in French Patent 2 561 946.

There are, however, other stabilizing methods which are known from prior art. The extraction of aluminum by chelating agents, such as ethylene diamine tetracetic acid or acetylacetone, should be mentioned. It is also possible to proceed to partial substitutions of aluminum atoms in the crystal lattice by atoms of exogenous silicon. This is the principle underlying the high-temperature treatments with silicon tetrachloride described in A. R. Beyer et al., Catalysis by Zeolites, ed. B. Imelik et al., Elsevier, Amsterdam, 1980, p. 203. It is also the principle underlying treatments carried out in liquid phase with fluorosilicic acid, or salts of that acid, by a method described in U.S. Pat. Nos. 3,594,331 and 3,933,983 and EP 0 002 221.

After all of these stabilization treatments, exchanges can be effected with cations of Group IIA metals, cations of rare earths or cations of chromium and zinc, or with any other element which can improve the catalyst.

The HY or $NH_4Y$ zeolite thus obtained or any other HY or $NH_4Y$ zeolite with these characteristics may be incorporated in the previously described matrix in the alumina gel state at this stage. The resultant catalyst comprises 20 to 97% by weight of matrix, 3 to 80% by weight of zeolite and at least one hydro-dehydrogenation component. One of the methods of incorporating zeolite in the matrix which is preferred in the invention comprises kneading the zeolite and gel together, then passing the dough thus obtained through a die to form extrusions of from 0.4 to 4 mm in diameter.

The hydro-dehydrogenation component of the catalyst according to the invention may, e.g., be at least one compound (e.g., an oxide) of a metal from Group VIII of the Periodic Table (especially palladium or platinum), or a combination of at least one compound of a metal selected from Group VI (especially molybdenum or tungsten) and at least one compound of a metal from Group VIII (especially cobalt or nickel).

The concentrations of metal compounds, expressed as the weight of metal relative to the finished catalyst, are as follows: from 0.01 to 5% by weight of Group VIII metals, and preferably from 0.03 to 3% by weight in cases where they are exclusively noble metals of the palladium or platinum type; from 0.01 to 15% by weight of Group VIII metals, and preferably from 0.05 to 10% by weight in cases where they are non-noble Group VIII metals, e.g., of the nickel type; when at least one metal or metal compound from Group VIII and at least one metal or metal compound from Group VI are used at the same time, about 5 to 40% and preferably 12 to 30% by weight of a combination of at least one compound (particularly an oxide) of a Group VI metal (particularly molybdenum or tungsten) and at least one Group VIII metal or metal compound (particularly cobalt or nickel) is employed, with a weight ratio (expressed in metal oxides) of Group VIII to Group VI metals of from 0.05 to 0.8 and preferably from 0.13 to 0.5.

The catalyst may advantageously contain phosphorus; this compound is indeed known, from prior art, to bring two advantages to hydrotreatment catalysts: ease of preparation, particularly when impregnating with nickel and molybdenum solutions, and improved hydrogenating activity. The phosphorus content, expressed as the concentration of phosphorus oxide $P_2O_5$, will be below 15% by weight and preferably below 10% by weight.

The hydrogenating function as defined above may be incorporated in the catalyst at various levels of preparation and in various ways, as described in French patent 2 561 946.

Catalysts based on $NH_4Y$ or HY zeolite as described above are, if necessary, subjected to a final calcination stage to obtain a catalyst based on Y zeolite in hydrogen form. The catalysts thus finally obtained are used to hydroisomerize charges emanating from the Fischer-Tropsch process under the following conditions: Hydrogen is reacted with the charge in contact with a catalyst 1 contained in the reactor R1 (or the first reaction zone R1), the function of which is to remove the unsaturated and oxygenated hydrocarbon molecules produced in Fischer-Tropsch synthesis. The effluent from the reactor R1 is put into contact with a second catalyst 2 contained in the reactor R2 (or the second reaction zone R2), the function of which is to provide the hydroisomerization reactions. The effluent from the reactor 2 is fractionated into various conventional petroleum cuts such as gases, gasolines, middle distillates and "isomerized residue"; the fraction described as "isomerized residue" represents the heaviest fraction obtained in fractionation, and the oil fraction is extracted from it. Extraction of the oil fraction traditionally takes place during the operation described as deparaffining. The choice of temperatures during the stage of fractionating effluent from the reactor 2 may vary greatly, according to the specific needs of the refiner. Adjustment of the reaction temperature enables varying yields to be obtained from each cut.

Various modifications can be made. It is possible to use only the reactor 2 if the quantities of non-saturated products in the charge do not cause excessive deactivation of the catalytic system. It is also possible to recycle all or part of the non-oily fraction obtained at the stage of deparaffining the "isomerised residue" to R1 or R2.

The use of such a process has several features:

The main aim is to obtain a large quantity of products resulting from hydroisomerization of the molecules present in the initial charge. In particular, it is important to obtain products which can then be used as components of lubricating products.

The partial pressure of hydrogen is from 5 to 200 bars and preferably from 30 to 200 bars.

Operating conditions in the zone R2 are an hourly speed per volume (VVH) of from 0.2 to 10 and preferably from 0.5 to 5 m3 of charge/m3 of catalyst/hour and a reaction temperature of from 150° to 450° C. and preferably from 170° to 350° C. Operating conditions applied to the zone R1 may vary greatly according to the charge, the purpose being to reduce concentrations of unsaturated and/or heteroatomic compounds to suitable levels. Under these operating conditions, the cycle of the catalytic system lasts at least one year and preferably 2 years, and deactivation of the catalyst, i.e., the temperature increase which the catalytic system must undergo to obtain constant conversion is less than 5° C./month and preferably less than 2.5°/month.

Oils obtained by the method of the invention have very good properties owing to their very paraffinic nature. For example, the viscosity index (VI) of the oil obtained after deparaffining (dewaxing) the 380+ cut with MEK/toluene solvent is at least 130 and preferably over 135, and the pour point is no higher than −12° C. In the case of the zeolitic catalyst, the yield is from 5 to 70% and preferably from 10 to 60% by weight.

The catalyst contained in the reactor R1 comprises at least one compound of a Group VIII metal, such as molybdenum, tungsten, nickel and/or cobalt and a matrix, preferably not containing any zeolite.

The catalyst 1 at the first stage comprises a matrix based on alumina and preferably not containing any zeolite, and at least one metal or metal compound with a hydro-dehydrogenating function. The matrix may also contain silica-alumina, boron oxide, magnesia, zirconia, titanium oxide, clay or a combination of these oxides. The hydro-dehydrogenating function is provided by at least one metal or metal compound from Group VIII, particularly nickel and cobalt. A combination of at least one metal or metal compound from Group VI of the Periodic Table (particularly molybdenum or tungsten) and at least one metal or metal compound from Group VIII (particularly cobalt and nickel) may be used. The catalyst may advantageously contain phosphorus; it is indeed known in prior art that this compound brings two advantages to hydrotreatment catalysts: ease in preparation, particularly when impregnating with nickel and molybdenum solutions, and improved hydrogenating activity. The total concentration of metals of Groups VI and VIII, expressed as metal oxides, is from 5 to 40% and preferably from 7 to 30% by weight; and the weight ratio, expressed as metallic oxide, metal (or metals) of Group VI to metal (or metals) of Group VIII, is from 1.25 to 20 and preferably from 2 to 10. The concentration of phosphorus oxide $P_2O_5$ will be less than 15% and preferably less than 10% by weight.

The catalyst contained in the reactor R2 is that described at the beginning of the "Summary of the Invention". It particularly comprises at least one HY zeolite haung an $SiO_2/Al_2O_3$ molar ratio of over 4.5 and preferably from 8 to 70; a sodium content less than 1% and preferably less than 0.5% by weight determined on zeolite calcined at 1100° C.; an $a_o$ crystal parameter of the elemental mesh less than $24.70\times10^{-10}$ meters and preferably from $24.24\times10^{-10}$ to $24.55\times10^{-10}$ meters; and a specific surface area determined by the BET method of over 400 $m^2.g^{-1}$ and preferably over 550 $m^2.g^{-1}$.

The examples given below illustrate the features of the invention without limiting its scope.

EXAMPLE 1

Preparation of Catalyst A (not according to the invention)

A laboratory-prepared silica-alumina is used, containing 25% by weight of $SiO_2$ and 75% by weight of $Al_2O_3$. 3% by weight of 67% pure nitric acid relative to the dry weight of silica-alumina powder is added to obtain peptisation of the powder. After being kneaded, the dough obtained is extruded through a die 1.4 mm in diameter. The extrusions are calcined, then impregnated dry with a solution of a salt of platinum tetramine chloride $Pt(NH_3)_4Cl_2$, and finally calcined in air at 550° C. The platinum content of the final catalyst is 0.6% by weight.

EXAMPLE 2

Preparation of catalyst B (according to the invention)

NaY zeolite is subjected to two exchanges in ammonium chloride solutions so that the sodium content is 2.6%. The product is then placed in a cold furnace and calcined in air to 400° C. A throughput of water corresponding, after vaporization, to a partial pressure of 50.7 kPa is introduced into the calcining atmosphere at that temperature. The temperature is brought to 565° C. for two hours. The product is then subjected to an exchange with an ammonium chloride solution, followed by a very careful acid treatment under the following conditions: volume of 0.4N hydrochloric acid to weight of solid = 10, duration 3 hours. The sodium content drops to 0.6% by weight and the $SiO_2/Al_2O_3$ ratio is 7.2:1. The product is subjected to violent calcination in a static atmosphere at 780° C. for 3 hours, then put back into acid solution by 2N hydrochloric acid with a volume of solution to weight of zeolite ratio of 10. The crystal parameter is $24.28\times10^{-10}$ meters, the specific surface area 825 m2/g, the water absorption capacity (reprise), 11.7 and the sodium ion absorption capacity, 1.0, expressed as weight of sodium per 100 g of dealuminated zeolite.

The resultant zeolite is kneaded with type SB3 alumina supplied by Condéa. The kneaded dough is extruded through a die 1.4 mm in diameter. The extrusions are calcined, then impregnated dry with a solution of a salt of platinum tetramine chloride $Pt(NH_3)_4Cl_2$ and finally calcined in air at 550° C. The platinum content of the final catalyst is 0.6% by weight.

EXAMPLE 3

Assessment of catalysts A and B in a test carried out under hydroisomerization conditions without recycling the "residue" fraction Catalysts prepared as described in the preceding examples are used under hydroisomerization conditions on a charge of paraffins emanating from Fischer-Tropsch synthesis, the chief characteristics of which are as follows:

| | |
|---|---|
| initial point | 114° C. |
| 10% point | 285° C. |
| 50% point | 473° C. |
| 90% point | 534° C. |
| final point | 602° C. |
| pour point | +67° C. |
| density (20/4) | 0.825 |

The catalytic test unit comprises one fixed-bed reactor with an upflow, in which 80 ml of catalyst are placed. The catalyst is subjected to an atmosphere of pure hydrogen at a pressure of 50 MPa to reduce the platinum oxide to metallic platinum, then the charge is finally injected. The total pressure is 5 MPa, the flow rate of hydrogen is 1000 liters of hydrogen gas per liter of charge injected, and the hourly speed by volume is 0.5.

When the reaction temperature increases, the total conversion of the charge and the yield from deparaffining the fraction described as the "isomerized residue" appear to increase in all cases. The catalytic performance obtained with the two catalysts A and B is set forth in the table below. The oils obtained in all cases have a VI above 150 and a pour point below −12° C. The values for the oil yield/charge are rounded up to the next number.

| | Catalyst A | | Catalyst B | |
|---|---|---|---|---|
| % wt zeolite/carrier | 0 | | 20 | |
| reaction temperature (°C.) | 320 | 340 | 230 | 260 |
| % wt 400⁻/effluents | 24.5 | 39.8 | 24.4 | 43.6 |
| % wt 400⁺/effluents | 75.5 | | 75.6 | 56.4 |
| yield from deparaffining | 28 | 74 | 28 | 73 |
| % wt oil/charge | 25 | 45 | 24 | 41 |

The % wt oil/charge yields appear to be substantially identical. On the other hand, the use of zeolite brings a very substantial gain in activity, since a temperature gain of 80° to 90° C. is observed with the same deparaffining yield being obtained.

EXAMPLE 4

Assessment of catalyst B in a test carried out under hydroisomerization conditions without recycling the "residue" fraction, and in a test carried out under hydroisomerization conditions with recycling of the non-oily fraction obtained after the "residue" fraction has been deparaffined at the inlet to reactor 2, referred to as R2

The catalyst prepared as described in Example 2 is used under hydroisomerization conditions on a charge of paraffins emanating from Fischer-Tropsch synthesis, its chief features being as follows:

| | |
|---|---|
| initial point | 114° C. |
| 10% point | 285° C. |
| 50% point | 473° C. |
| 90% point | 534° C. |
| final point | 602° C. |
| pour point | +67° C. |
| density | 0.825 |

The catalytic test unit comprises one fixed-bed reactor with an upflow, in which 80 ml of catalyst are placed. The catalyst is subjected to an atmosphere of pure hydrogen at a pressure of 50 MPa to reduce the platinum oxide to metallic platinum, then the charge is finally injected. The total pressure is 5 MPa, the flow rate of hydrogen is 1000 liters of hydrogen gas per liter of charge injected, and the hourly speed by volume is 0.5.

In one case the reaction is carried out without and in the other case with recycling of the non-oily fraction obtained after the residue fraction has been dewaxed: the non-oily fraction obtained after dewaxing is currently described as "deparaffining cake". Operating conditions are adjusted to give the same net conversion of the residue (i.e., of the 400+ fraction).

The catalytic performance obtained with catalyst B with and without recycling of the "deparaffining cake" is given in the table below. The values for the dewaxing yields and oil/charge are rounded up to the next number.

| | Catalyst B without recycling | Catalyst B with recycling |
|---|---|---|
| % wt 400⁻/effluents | 40 | 37 |
| % wt 400⁺/effluents | 60 | 63 |
| deparaffining yield | 74 | 74 |

-continued

| | Catalyst B without recycling | Catalyst B with recycling |
|---|---|---|
| % wt oil/charge | 44 | 56 |

The oils obtained have a viscosity index (VI) above 150 and a pour point below −12° C. in all cases. The oil/charge yield by weight appears to be improved considerably by the use of recycling.

We claim:

1. A method of hydroisomerizing charges emanating from a Fischer-Tropsch process containing unsaturated and oxygenated molecules, comprising:

(a) reacting hydrogen with the charge in contact with a first catalyst in a first reaction zone, the first catalyst comprising at least one alumina-based matrix and at least one hydro-dehydrogenation component to remove the unsaturated and oxygenated molecule;

(b) contacting the effluent from the first reaction zone with a second catalyst in a second reaction zone wherein said effluent is hydroisomerized, the second catalyst comprising:

20% to 97% by weight of at least one matrix;

3% to 80% by weight of at least one Y zeolite in hydrogen form, the zeolite having an $SiO_2/Al_2O_3$ molar ratio of over 4.5, a sodium content of less than 1% by weight determined at 1100° C. under calcining conditions, an $a_o$ crystal parameter of the elemental mesh of less than $24.70\times10^{-10}$, and a specific surface area determined by the BET method of over 400 $m^2.g^{-1}$; and at least one hydro-dehydrogenation component;

(c) withdrawing a hydroisomerized effluent from said second reaction zone; and (d) dewaxing a fraction of said effluent to obtain an oil having a viscosity index of at least 130 and a pour point no higher than −12° C.

2. The method of claim 1, wherein the Y zeolite has a $SiO_2/Al_2O_3$ molar ratio of 8 to 70, a sodium content of less than 0.5% by weight determined on a zeolite calcined at 1000° C., an $a_o$ crystal parameter of the elemental mesh of $24.24\times10^{-10}$ to $24.55\times10^{-10}$ m, and a specific surface area determined by the BET method of over 550 $m^2.g^{-1}$.

3. The method of claim 1, wherein the hydro-dehydrogenation component of the first stage, is a combination of at least one metal or metal compound from Group VIII of the Periodic Table and at least one metal or metal compound from Group VI.

4. The method of claim 3 wherein, in stage b), from 5 to 40% by weight of the metal compounds is used relative, the second catalyst, the weight ratio, expressed as metal oxides, of Group VIII to Group VI metals being from 0.05 to 0.8:1 and, in the stage a), 5 to 40% by weight of metal compounds is used, relative to second catalyst, the weight ratio, expressed as metal oxides, of Group VIII to Group V metals being from 1.25 to 20.

5. The method of claim 1, wherein the hydro-dehydrogenation component of the first stage, is at least one metal or metal compound from Group VIII of the Periodic Table.

6. The method of claim 5, wherein the hydro-dehydrogenation component of the first stage, is a noble metal selected from the group formed by platinum and palladium.

7. The method of claim 5 wherein, in stage b), the concentration of Group VIII metal, expressed as weight relative to the second catalyst, is from 0.01 to 5% for a noble metal and from 0.01 to 15% by weight for a non-noble metal.

8. The method of claim 3, wherein the hydro-dehydrogenation component of the first stage, further comprises phosphorus.

9. The method of claim 8, wherein the phosphorus content, expressed as the weight of phosphorus oxide $P_2O_5$ relative to the second catalyst, is below 15%.

10. The method of claim 1, further comprising fractionating the hydroisomerized effluent from the second reaction zone to obtain an isomerized residue fraction, dewaxing said isomerized residue to obtain a non-oily deparaffining cake, and recycling said deparaffining cake to an inlet of one of the reaction zones.

11. The method of claim 10, wherein recycling is effected to the inlet of the first reaction zone.

12. The method of claim 2, wherein the hydro-dehydrogenation component of the first stage, is a combination of at least one metal or metal compound from Group VIII of the Periodic Table and at least one metal or metal compound from Group VI.

13. The method of claim 12, wherein, in stage b), from 5–40% by weight of the metal compounds is used, relative to the second catalyst, the weight ratio, expressed as metal oxides, of Group VIII to Group VI metals being from 0.05 to 0.8:1 and, in stage a), 5–40% by weight of the metal compounds is used, relative to the second catalyst, the weight ratio, expressed as metal oxides, of Group VIII to Group V metals being from 1.25 to 20.

14. The method of claim 2, wherein the hydro-dehydrogenation component of the first stage, is at least one metal or metal compound from Group VIII of the Periodic Table.

15. The method of claim 14, wherein the hydro-dehydrogenation component of the first stage, is a noble metal selected from the group formed by platinum and palladium.

16. The method of claim 14, wherein, in stage b), the concentration of the Group VIII metal, expressed as weight relative to the second catalyst, is from 0.01–5% for a noble metal and from 0.01–15% by weight for a non-noble metal.

17. The method of claim 5, wherein the hydro-dehydrogenation component of the first stage, further comprises phosphorus.

18. The method of claim 14, wherein the hydro-dehydrogenation component of the first stage, further comprises phosphorus.

19. The method of claim 6, wherein the hydro-dehydrogenation component of the first stage further comprises phosphorus.

20. The method of claim 7, wherein the hydro-dehydrogenation component of the first stage, further comprises phosphorus.

21. The method of claim 10, wherein the recycling is conducted to the inlet of the second reaction zone.

* * * * *